United States Patent [19]

Liston

[11] Patent Number: 4,804,603

[45] Date of Patent: Feb. 14, 1989

[54] ELECTROPHOTOGRAPHIC METHOD AND APPARATUS

[75] Inventor: Christopher B. Liston, Rochester, N.Y.

[73] Assignee: Eastman Kodak Company, Rochester, N.Y.

[21] Appl. No.: 99,043

[22] Filed: Sep. 21, 1987

[51] Int. Cl.[4] ..... G03G 13/01; G03G 13/052; G03G 13/22

[52] U.S. Cl. ..... 430/45; 430/31; 430/42; 430/54; 430/902; 430/126

[58] Field of Search ..... 430/31, 42, 45, 54, 430/902, 126

[56] References Cited

U.S. PATENT DOCUMENTS

| | | | |
|---|---|---|---|
| 4,500,616 | 2/1985 | Haneda et al. | 430/45 |
| 4,539,281 | 9/1985 | Tanaka et al. | 430/45 |
| 4,562,129 | 12/1985 | Tanaka et al. | 430/42 |
| 4,562,130 | 12/1985 | Oka | 430/54 |

*Primary Examiner*—Roland E. Martin

*Attorney, Agent, or Firm*—Leonard W. Treash, Jr.

[57] ABSTRACT

An electrophotosensitive member is uniformly charged and portions to be toned by one type toner are erased. Those portions are filled in with a charge of different potential, for example, a charge of polarity opposite to that of the original charge. The charged member is imagewise exposed and developed with two toners selectively attractive to the different charge potentials. With this method a multicolor image can be formed with a single exposure.

7 Claims, 1 Drawing Sheet

ELECTROPHOTOGRAPHIC METHOD AND APPARATUS

TECHNICAL FIELD

This invention relates to electrophotography, and more specifically to an electrophotographic method in which a visible image of toner of first and second characteristics, for example, toner of contrasting colors, is applied to an electrostatic image. This invention also relates to apparatus for practicing such an invention.

BACKGROUND ART

Reproduction apparatus, for example color copiers, are presently on the market which produce copies having portions colored as programmed by the operator. These copiers may work from a monocolor original. U.S. Pat. No. 4,045,218 shows an apparatus in which an original is placed at a work station and an indicator adjusted to identify the lines to be reproduced in a first color. An electrostatic image is formed of the original, and, in response to the indicator, a portion of the image is erased. That electrostatic image is reproduced in a first color. Then, a second electrostatic image is formed, with the complementary portion of the original erased and a second color applied. The two images are then transferred in registry onto a receiver to give a copy of the original but with different colors in the areas designated by the operator.

In actual practice this process has been improved by the introduction of a sonic digitizer to be used by the operator in indicating the portion of the original to be specially treated. Other mechanisms have been suggested for inputting the location of the portions of the image to be specially treated to the control portion of the apparatus. For example, these portions may be highlighted on the original and the highlighting sensed during exposure, to input the control information.

Unfortunately, all of the above apparatus and methods require the creation of at least two separate images in the copy machine. Those two images must then be combined. These two steps in this known method create at least two problems. First, complete copies require two image frames and two exposures and therefore can be made only half as fast with two colors as images can be made with a single color. Second, the images must be combined at a transfer station with proper registration. This is commonly done by either recirculating the copy sheet back to a point at the beginning of the copy sheet path and feeding it through the transfer station again or by securing the copy sheet on a drum which presents the copy sheet to the image frames two times. In the first instance registration is quite difficult and the recirculating path is expensive. In the second instance manufacture of the drum and accurate and complete holding of the copy sheet is quite difficult, requiring vacuum or finger hold downs, either of which adds complexity and expense to the machine and often results in misregistration.

U.S. Pat. No. 4,634,259 is representative of a number of two color systems in which an electrophotosensitive member is charged to a first polarity and exposed to a first color image and then charged to a second and opposite polarity and exposed and toned to a second color image in register with the first exposure. The first toner image may be toned before or after the second charging step. This process, of course, requires two separate registered exposures. The second exposure is made on top of either an electrostatic image or a toner image, either of which images are likely to affect the second exposure.

DISCLOSURE OF THE INVENTION

It is the object of this invention to provide a method and apparatus for producing an electrophotographic reproduction which method includes the application of at least two toners of different characteristics and which method uses only a single exposure.

These and other objects are accomplished by a method having the following steps:

(1) applying charges of first and second potential to an electrophotosensitive member, which charges of the first potential are located generally in first portions to be toned with toner having a first characteristic and which charges of a second potential are located generally in second portions to be toned by toner of a second characteristic;

(2) imagewise exposing said charged electrophotosensitive member to a radiation image to form an electrostatic image in both said first and second portions;

(3) applying toner of a first characteristic, for example, of a first color, to the member under such conditions that the portions of the image defined by the charges of the first potential are developed; and (4) applying toner of a second characteristic, for example, of a second color, to the member under such condition that the portions of the image defined by the charges of the second potential are developed.

According to a preferred embodiment the first step of the above method is performed by first applying a charge of a first polarity to the electrophotosensitive element, erasing that charge in the areas to receive a toner of a particular characteristic and applying a charge of opposite polarity to only those areas, for example, by selective ion deposition.

The object is also accomplished by an apparatus for carrying out the above method as more fully described herein. According to a preferred embodiment of such apparatus, first and second toner applying means include magnetic brushes having toner charged to polarities attractive to the separate image portions, each bush having its own electric field which urges the deposition of toner on the portions of the images for which it is intended and inhibits the deposition of toner elsewhere on the electrophotosensitive member.

The above method and apparatus forms a composite toner image having toners of two different characteristics, for example, contrasting colors, as controlled by the operator, but using a single exposure step and without the need for separate registration of the two images.

BEST MODE OF CARRYING OUT THE INVENTION

Figure 1:
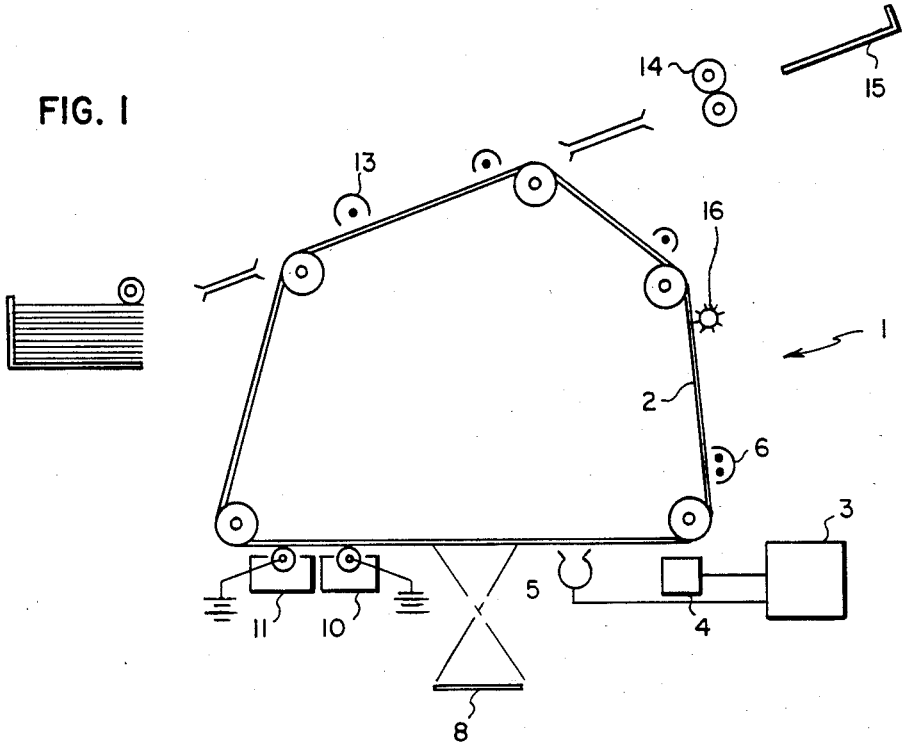
FIGS. 1 and 2 are schematic side views of copiers constructed according to alternative embodiments of the invention.

According to FIG. 1 an electrophotographic copier 1 includes an electrophotosensitive member 2, having one or more image frames, mounted on rollers for movement through a series of stations as is well known in the art. Electrophotosensitive member 2 is preferably a bipolar photoconductor with a conductive backing. A logic and control unit 3 is programmed to receive data indicative of which portions of an original are to be reproduced in a first color and which portions of the same original are to be reproduced in a second color. As stated above in reference to U.S. Pat. No. 4,045,218, many approaches to so programming logic and control unit 3 to derive signals defining areas to be so treated are known.

Logic and control unit 3 is connected to an LED erase head 4 and a selective ion projection head 5. LED erase head 4 is similar to LED writers presently used in non-impact printers and other apparatus for writing at resolutions in excess of 300 dots per inch. For this application, an erase head having much lower resolution can be used, for example, 25 to 50 dots per inch. Selective ion projection heads 5 are also available commercially, for example, the Markem 200 dots per inch ion projection head can be used to selectively project positive ions on a moving surface such as electrophotosensitive member 2. Again, heads having lower resolution may be used for this application.

Electrophotosensitive member 2 is moved in a clockwise direction and is first given a uniform charge, for example, a negative charge, by a primary corona charger 6. The charged electrophotosensitive member 2 passes under LED erase head 4 which erases charged in a first portion of a projected image frame as controlled by logic and control unit 3. The now partially erased electrophotosensitive member 2 passes under selective ion projection head 5 which applies a positive charge to only those areas erased by selective erase head 4 also as controlled by logic and control unit 3. The electrophotosensitive member 2 is now exposed at an exposure station 8, dissipating the charge in the background areas leaving a positive polarity electrostatic image in the areas originally erased by selective erase head 4 and a negative polarity electrostatic image in the areas not erased by erase head 4. The exposure station 8 may be an ordinary optical exposure, for example, a flash exposure, or it may be an electronically controlled exposure using a laser, LED print head or the like responsive to electronically generated information.

The electrostatic image carried by electrophotosensitive member 2 now passes through first and second development stations 10 and 11 which contain toners of opposite polarity. For example, the first development station 10 can include black toner containing a positive charge which is attracted to the negative electrostatic image in the areas not erased by the erase head 4. Similarly, the second development station 11 can include red toner containing a negative charge which is attracted to the positive electrostatic image in the areas erased by the erase head 4. To assist the development process, bias is applied to each development station which urge deposition of toner on the intended images but inhibit deposition of toner in the background areas and the other image. For example, if a slight negative bias is applied to the first development station and a slight positive bias is applied to the second development station, the respective toners will be urged only to the appropriate images. Although ordinary magnetic brushes can be used for development stations 10 and 11, some pick up by the second station 11 of toner deposited by the first station 10 can take place. This phenomenon is greatly reduced if at least the second station toning is accomplished by projection of toner across a minute gap in the presence of an alternating field, a system well known in the art.

The two-color image leaving the development station is then transferred to a receiving member at a transfer station 13, and the receiving member is fed through a fuser 14 to a output hopper 15. The electrophotosensitive member is cleaned at a cleaning station 16 and reused. Further, this invention is not limited to processes in which the toner image is transferred, but can be used, for example, in processes in which the toner image is fixed to the electrophotosensitive member itself. Transfer of a toner image made up of different polarity toner can be effected with an AC corona applied to the rear of the receiving member as shown in the Figs. Alternatively, the transfer can be accomplished by other non-electrostatic means, for example, by heating the toner or by use of an adhesive receiving surface.

Figure 2:
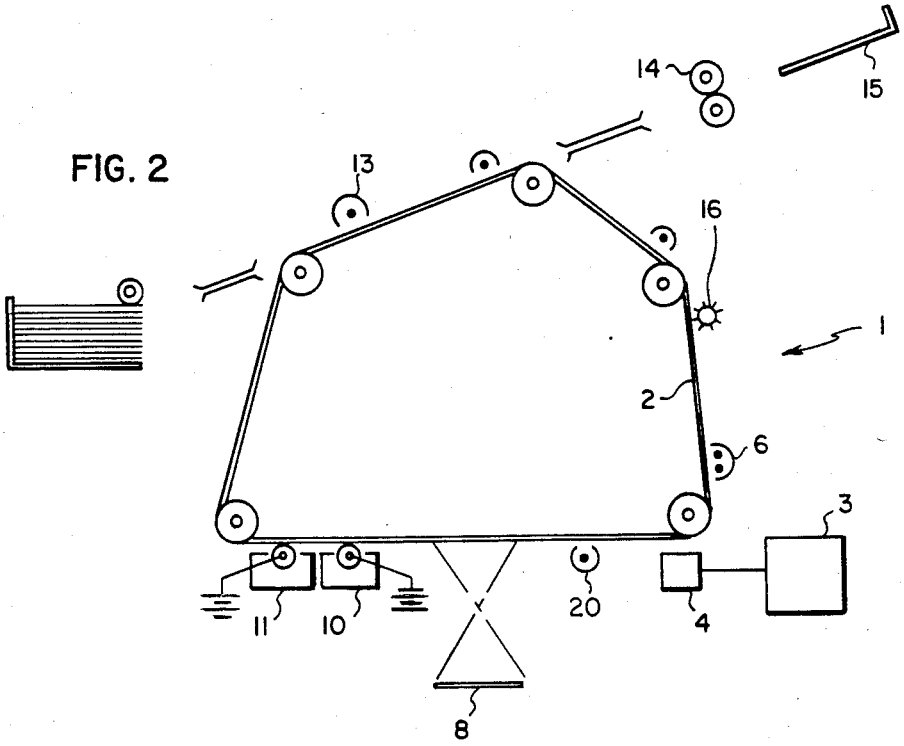

According to FIG. 2, a second embodiment of the invention is substantially the same as the embodiment shown in FIG. 1 except that instead of using an ion projection head to fill in the discharged areas with charge of the opposite polarity, a second uniform corona of opposite polarity but lesser magnitude is applied at a second corona station 20. In this instance the method follows the first except that a substantial negative charge, for example 600 volts, is applied at corona charger 6 and that charge is erased in certain portions by erase head 4 leaving a substantial negative charge, for example 500 volts, in the non-erased portions. An auxiliary corona charger 20 now applies a small positive corona charge uniformly to the electrophotosensitive member of, for example, a charge of 300 volts. The resulting charge on the electrophotosensitive member 2 is dependent upon the charge-receiving characteristics of that member to the charges of the respective polarities. However, using a symmetrically bipolar electrophotosensitive member, these conditions produce an intermediate level charge, for example, 200 volts, of opposite polarity in the two portions. The rest of the process then works as in FIG. 1, although producing a lower contrast image.

The invention has been described in detail with particular reference to a preferred embodiment thereof, but it will be understood that variations and modifications can be effected within the spirit and scope of the invention as described hereinabove and as defined in the appended claims.

I claim:

1. An electrophotographic method of producing a toner image made up of at least two toners of different characteristics, said method comprising the steps of:

(1) applying charges of first and second potential to an electrophotosensitive member, which charges of the first potential are located generally in first portions to be toned with toner having a first characteristic and which charges of a second potential are located in second portions to be toned by toner of a second charcteristic;

(2) imagewise exposing said charged electrophotosensitive member to a radiation image, to form an electrostatic image in both said first and second portion;

(3) applying toner of a first characteristic to said member under such conditions that the portion of said image defined by the charges of the first potential are developed; and (4) applying toner of a second characteristic to said member under such conditions that the portion of said image defined by the charges of the second potential are developed.

2. The method according to claim 1 in which the first step includes applying a uniform charge of a first polarity to said member, selectively erasing said charge on the second portions and selectively applying a charge of a polarity opposite to said first polarity to the second portions.

3. The method according to claim 2 wherein step (3) includes applying toner of a polarity opposite said first polarity to said member in the presence of an electric field of a direction urging toning of the image in said first portion and inhibiting toning of other areas of said member and step (4) includes applying toner of said first polarity to said member in the presence of an electric field urging toning of the image in said second portion and inhibiting toning of other areas of said member.

4. The method according to claim 1 in which steps (3) and (4) include the application of toners of different color.

5. The method according to claim 3 in which steps (3) and (4) include the application of toners of different color.

6. The method according to claim 2 wherein said substep of selectively applying a charge is accomplished by selective ion deposition.

7. The method according to claim 2 further including the step of transferring the toner applied in steps (3) and (4) to a receiving surface.

* * * * *